US007900594B2

(12) United States Patent
Gwidt et al.

(10) Patent No.: US 7,900,594 B2
(45) Date of Patent: Mar. 8, 2011

(54) SYSTEM AND METHOD FOR INJECTING FUEL INTO A DIRECT INJECTION ENGINE

(75) Inventors: Jesse M. Gwidt, Brighton, MI (US); Karen Margaret-Bell Gwidt, Brighton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 727 days.

(21) Appl. No.: 11/862,543

(22) Filed: Sep. 27, 2007

(65) Prior Publication Data

US 2009/0084347 A1 Apr. 2, 2009

(51) Int. Cl.
*F02B 3/00* (2006.01)

(52) U.S. Cl. ..... 123/299; 701/103

(58) Field of Classification Search ..... 123/295, 123/299, 300, 305, 435, 436, 479; 701/103, 701/104, 105, 111, 114; 73/116, 117.3; 60/284, 285

See application file for complete search history.

(56) References Cited

U.S. PATENT DOCUMENTS 6,516,608 B1 * 2/2003 Poggio et al. ..... 60/284
2006/0054132 A1 * 3/2006 Uchiyama ..... 123/299

* cited by examiner

*Primary Examiner* — Stephen K Cronin
*Assistant Examiner* — J. Page Hufty

(57) ABSTRACT

A method for controlling the operation of at least one fuel injector in a four stroke internal combustion engine is provided. The method includes the steps of initiating fuel injection into a combustion chamber during an expansion stroke of the engine, injecting fuel into the combustion chamber during an exhaust stroke of the engine, injecting fuel into the combustion chamber during an intake stroke of the engine, and terminating fuel injection into the combustion chamber during a compression stroke of the engine.

15 Claims, 3 Drawing Sheets

SYSTEM AND METHOD FOR INJECTING FUEL INTO A DIRECT INJECTION ENGINE

FIELD

The present disclosure relates to a direct injection internal combustion engine. More particularly, the invention relates to a system and method for injecting fuel into a direct injection internal combustion engine at a specified time and for a specified duration.

BACKGROUND

A typical internal combustion engine in a motor vehicle operates by combusting a mixture of a vaporized fuel (i.e. gasoline) and air in a cylinder or combustion chamber. Generally, the combustion chamber includes a piston that is forced to translate or move up and down as a result of the combustion of the fuel/air mixture. The piston is rotatably secured to a crankshaft. The movement of the piston rotates the crankshaft which ultimately rotates the drive wheels of the vehicle.

Many internal combustion engines have four-stages of operation. These stages, also referred to as strokes, relate to the position of the piston within the combustion chamber. For example, a typical four-stage operation includes an intake stroke, a compression stroke, an expansion stroke, and an exhaust stroke. During each stroke the piston moves from one end of the combustion chamber to the other end of the chamber and the crankshaft rotates 180 degrees. During the intake stroke the fuel mixture is drawn into the combustion chamber. During the compression stroke the fuel mixture is compressed and then ignited. During the expansion stroke the piston is forced toward the bottom of the combustion chamber by the combustion process. Finally, during the exhaust stroke the combustion gases are expelled from the combustion chamber.

Fuel is delivered to the combustion chamber using a fuel delivery system. Conventional fuel delivery systems include, for example, a fuel tank, a low pressure pump, a high pressure pump, a plurality of fuel lines, a fuel rail, a pressure sensor, and a fuel injector. The low pressure fuel pump pumps the fuel out of the fuel tank and pressurizes the fuel to a first pressure. The low pressure pump is typically electrically driven by the vehicle's battery. The high pressure pump pumps the fuel into the fuel rail at a second pressure that is higher than the first pressure. The high pressure pump is typically mechanically driven by the engine. The pressure sensor transmits a signal indicative of the pressure sensed in the fuel rail to a control device, such as a microcontroller. The fuel rail distributes the fuel to the fuel injectors which inject fuel into the cylinders of the engine.

Conventional fuel delivery systems inject fuel into the combustion chamber during the intake stroke and during the compression stroke. However, this method of injection is not sufficient to supply the required amount of fuel to the fuel injector during certain engine operating conditions, such as a cold start condition. This may result from, for instance, the pressure in the fuel rail being insufficient during the cold start condition because the high pressure fuel pump is unable to supply the necessary flow. This typically occurs because the engine is operating at a low speed during the cold start condition prior to reaching a steady state condition. As such, vehicles started under a cold start condition generally need more fuel than what the high pressure fuel pump is capable of delivering due to the low operating speed of the engine.

Accordingly, during cold start conditions these engines mostly rely on the low pressure fuel pump.

Therefore, there is a need for an improved system and method for delivering fuel to a direct injection engine to overcome the limitations of the conventional fuel delivery system during, for example, cold start conditions.

SUMMARY

The present invention provides a method for controlling the operation of at least one fuel injector in a direct injection four stroke internal combustion engine. The method includes the steps of initiating fuel injection into a combustion chamber during an expansion stroke of the engine, injecting fuel into the combustion chamber during an exhaust stroke of the engine, injecting fuel into the combustion chamber during an intake stroke of the engine, and terminating fuel injection into the combustion chamber during a compression stroke of the engine.

In one aspect of the present invention, the step of initiating fuel injection into the combustion chamber further includes initiating fuel injection during a first half of the expansion stroke of the direct injection internal combustion engine.

In another aspect of the present invention, the step of initiating fuel injection into the combustion chamber further includes initiating fuel injection during a second half of the expansion stroke of the direct injection internal combustion engine.

In yet another aspect of the present invention, the step of initiating fuel injection into the combustion chamber further includes initiating fuel injection between 620° to 660° of crankshaft rotation of the engine, wherein 0° of crankshaft rotation is the end of the compression stroke.

In still another aspect of the present invention, the step of terminating fuel injection into the combustion chamber further includes terminating fuel injection during a first half of the compression stroke of the direct injection internal combustion engine.

In still another aspect of the present invention, the step of terminating fuel injection into the combustion chamber further includes terminating fuel injection during a second half of the compression stroke of the direct injection internal combustion engine.

In still another aspect of the present invention, the step of terminating fuel injection into the combustion chamber further comprises terminating fuel injection between 40° to 80° of crankshaft rotation of the engine, wherein 0° of crankshaft rotation is the end of the compression stroke.

The present invention also provides a system for controlling the operation of at least one fuel injector in a direct injection four stroke internal combustion engine. The system includes a pressure sensor configured to sense the pressure in a fuel rail and transmit a signal indicative of the pressure. A microcontroller communicates with the pressure sensor for receiving the pressure signal. The microcontroller includes control logic for controlling the operation of the at least one fuel injector in response to the received pressure signal. The control logic includes a first control logic for initiating fuel injection into a combustion chamber during an expansion stroke of the engine, a second control logic for injecting fuel into the combustion chamber during an exhaust stroke of the engine, a third control logic for injecting fuel into the combustion chamber during an intake stroke of the engine, and a fourth control logic for terminating fuel injection into the combustion chamber during a compression stroke of the engine.

In one aspect of the present invention, the first control logic further comprises initiating fuel injection during a first half of the expansion stroke of the direct injection internal combustion engine.

In another aspect of the present invention, the first control logic further comprises initiating fuel injection during a second half of the expansion stroke of the direct injection internal combustion engine.

In yet another aspect of the present invention, the first control logic further comprises initiating fuel injection between 620° to 660° of crankshaft rotation of the engine, wherein 0° of crankshaft rotation is the end of the compression stroke.

In still another aspect of the present invention, the fourth control logic further comprises terminating fuel injection during a first half of the compression stroke of the direct injection internal combustion engine.

In still another aspect of the present invention, the fourth control logic further comprises terminating fuel injection during a second half of the compression stroke of the direct injection internal combustion engine.

In still another aspect of the present invention, the fourth control logic further comprises terminating fuel injection between 40° to 80° of crankshaft rotation of the engine, wherein 0° of crankshaft rotation is the end of the compression stroke.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
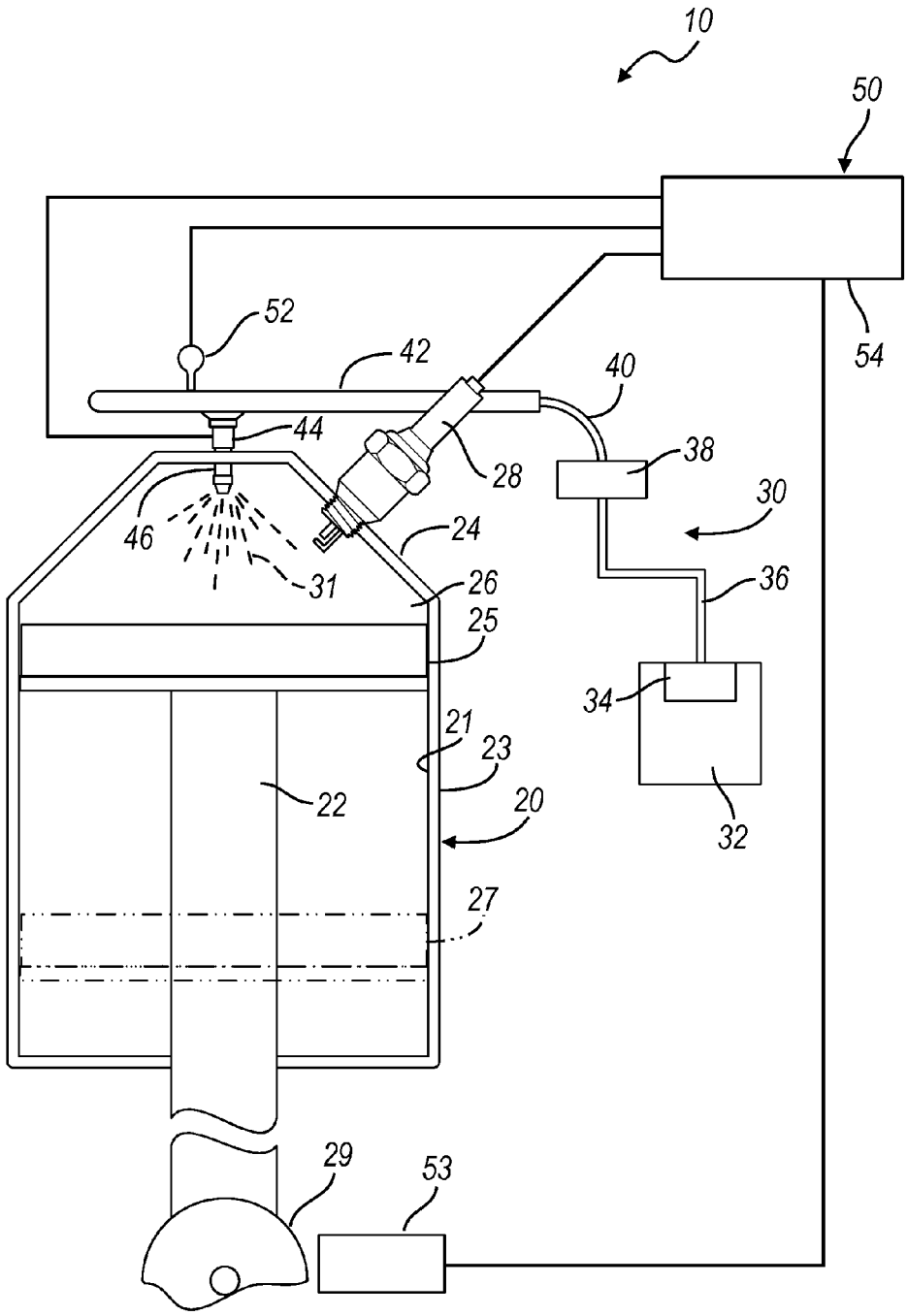
FIG. 1 is a schematic view of a system for injecting fuel in an internal combustion engine in accordance with an embodiment of the present invention.

Referring now to FIG. 1, a system for injecting fuel into a direct injection internal combustion engine is generally indicated by reference number 10. The system 10 includes an internal combustion engine 20, a fuel system 30, and a control system 50. The fuel system 30 is operable to provide fuel to the internal combustion engine 20 and is controlled by the control system 50.

The engine 20 generally includes a cylinder 21 defined by an engine block 23. The cylinder 21 is capped at an end thereof by a cylinder head 24. While in the particular example provided the engine 20 includes only one cylinder 21, it should be appreciated that the engine 20 may have any number of cylinders, arranged in various configurations, without departing from the scope of the present invention. The engine 20 further includes a piston 22 located within the cylinder 21. The piston 22 is configured to translate within the cylinder 21 between a top dead center ("TDC") position and a bottom dead center ("BDC") position. The TDC position is defined as the position of the piston 22 when it is closest to the cylinder head 24, indicated by reference number 25. The BDC position is defined as the position of the piston 22 when it is farthest from the cylinder head 24, indicated by reference number 27. The piston 22 is coupled to a crankshaft 29. The crankshaft 29 is actuated or rotated by the translation of the piston 22. The piston 22 and the cylinder head 24 define a combustion chamber 26 within the cylinder 21. The engine 20 also includes a spark plug 28. The spark plug 28 extends through the cylinder head 24 and into the combustion chamber 26. It should be appreciated that the orientation and configuration of the spark plug 28 may vary from what is shown in FIG. 1 without departing from the scope of the present invention. The spark plug 28 ignites a fuel/air mixture 31 present in the combustion chamber 26, as will be described in greater detail below.

The fuel system 30 includes a fuel tank 32, a low pressure fuel pump 34, a high pressure fuel pump 38, a first fuel line 36, a second fuel line 40, a fuel rail 42, and a fuel injector 44. The fuel tank 32 contains a combustible fuel, such as gasoline. The low pressure fuel pump 34 is connected to the fuel tank 32 and is operable to pump the fuel out of the fuel tank 32 at a first fuel pressure to a first fuel line 36. While in the particular example shown the low pressure fuel pump 34 is located within the fuel tank 32, it should be appreciated that the low pressure fuel pump 34 may be located external to the fuel tank 32 without departing from the scope of the present invention. The low pressure fuel pump 34 of this example may be activated or operated electrically, mechanically, hydraulically, or by any other means). The high pressure fuel pump 38 is connected to and receives fuel from the low pressure fuel pump 34 via the first fuel line 36. The high pressure fuel pump 38 of this example is driven by the engine 20 and is configured to pump fuel at a second fuel pressure that is greater than the first fuel pressure to the fuel rail 42 via the second fuel line 40. The fuel rail 42 is connected to the fuel injector 44 and is operable to distribute the fuel to the fuel injector 44. The fuel injector 44 is arranged centrally within the cylinder head 24 in the example provided and is configured to inject fuel into the combustion chamber 26. It should be appreciated that any number of fuel injectors 44, corresponding, for example, to the number of cylinders 21 within the engine 20, may be employed without departing from the scope of the present invention.

The control system 50 includes a pressure sensor 52, a crankshaft position sensor 53, and a microcontroller 54. The pressure sensor 52 is configured to sense the pressure in the fuel rail 42 and send a signal indicative of the pressure to the microcontroller 54. The crankshaft position sensor 53 is configured to sense the rotational position of the crankshaft 29. The microcontroller 54 is, for example, an electronic device having a preprogrammed digital computer or processor, control logic, memory used to store data, and at least one I/O peripheral. However, other types of microcontrollers may be employed without departing from the scope of the present invention. The control logic includes a plurality of logic routines for monitoring, manipulating, and generating data. The microcontroller 54 may be part of an engine control module for the motor vehicle or a separate module. The microcontroller 54 also is operable to determine a current operating state of the motor vehicle, for example, whether the motor vehicle is in a cold start condition defined as when the engine 20 has not been running for a period of time prior to ignition.

Figure 2:
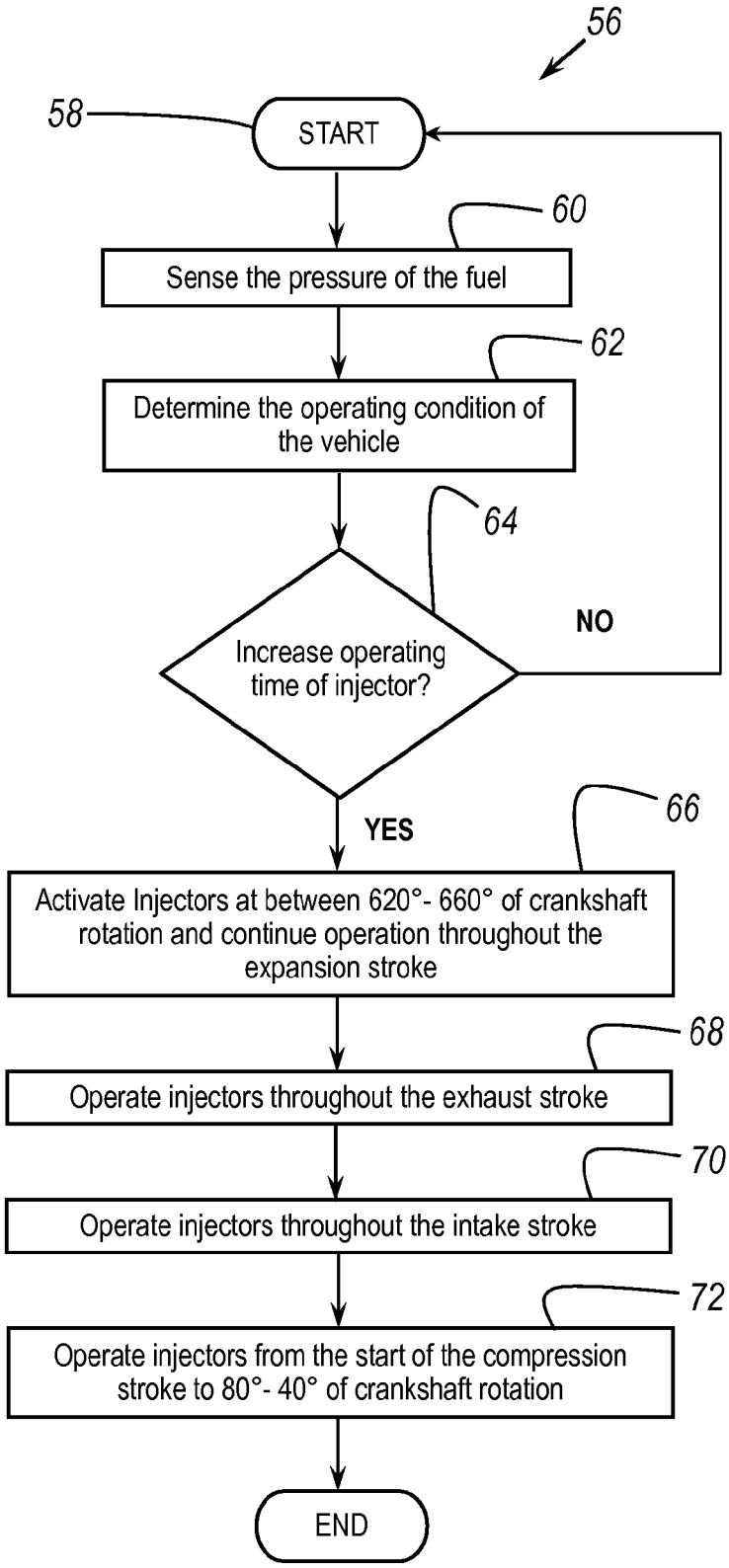
FIG. 2 is a method for increasing the operating time of a fuel injector to inject fuel into the internal combustion engine shown in FIG. 1.
Figure 3:
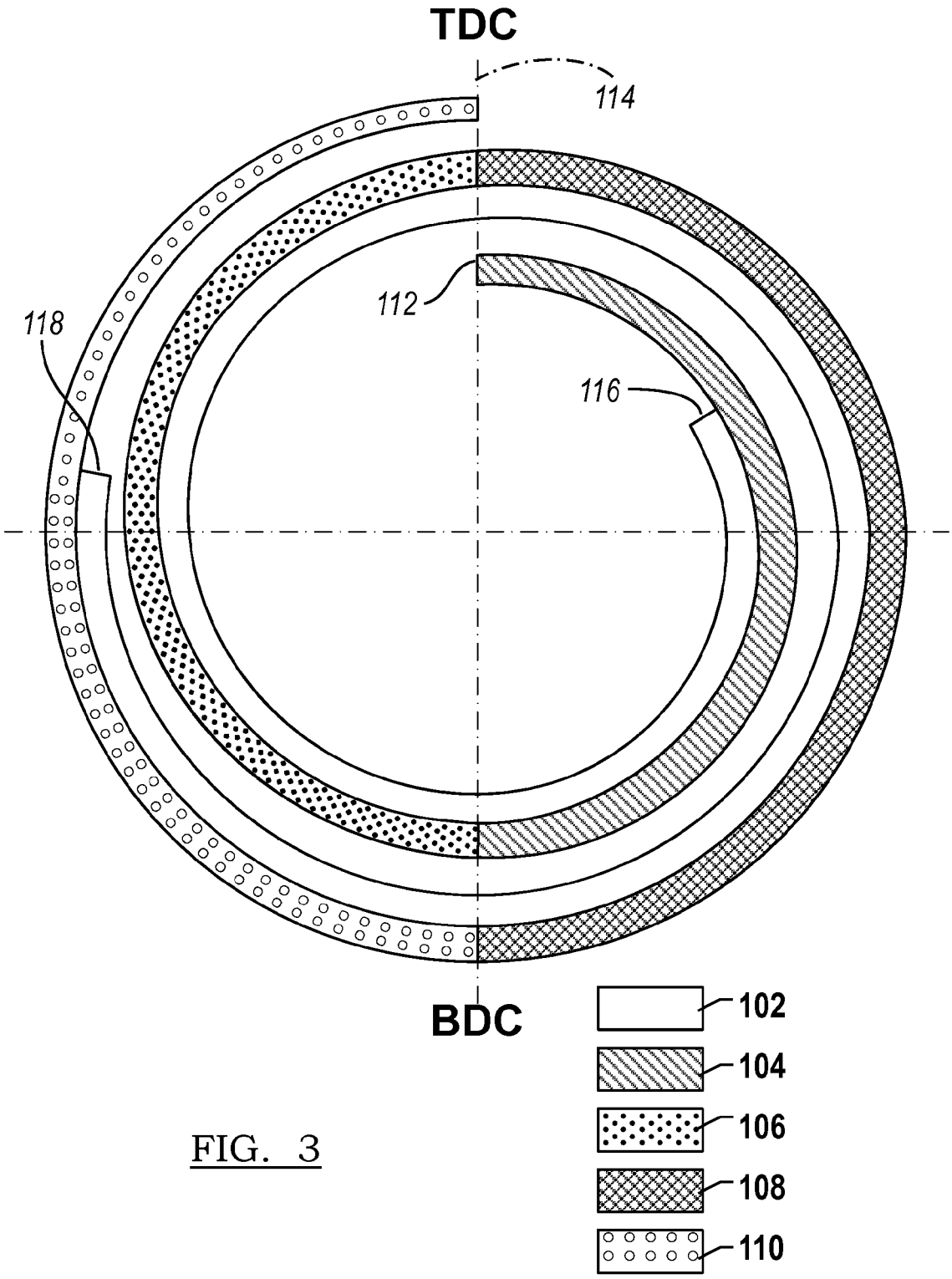
FIG. 3 is a diagram illustrating the operating time of a fuel injector from start of injection to end of injection relative to four cycles of the internal combustion engine shown in FIG. 1.

Turning to FIGS. 2 and 3, and with continued reference to FIG. 1, a method for increasing the operating time of the fuel injector 44 during certain operating conditions will now be described. In FIG. 2, the method for increasing the operating time of the fuel injector is illustrated in a flow chart indicated by reference number 56. FIG. 3 illustrates the operating time of the fuel injector 44, indicated by reference number 102, relative to the angle of rotation of the crankshaft 29 and the location of the piston 22 through the four cycles or stages of the engine 20. The operating time of the expansion stroke is indicated by reference number 104, the operating time of the exhaust stroke is indicated by reference number 106, the operating time of the intake stroke is indicated by reference number 108, and the operating time of the compression stroke is indicated by reference number 110. For explanatory purposes, the start of expansion stroke is defined herein as 720° of crankshaft rotation, indicated by reference number 112. And the end of the compression stroke is defined herein as 0° of crankshaft rotation, indicated by reference number 114. Fuel injection begins at a start of injection ("SOI") event 116 and terminates at an end of injection ("EOI") event 118. In the example provided, the method 56 is operable to increase the operating time of the fuel injector 44 and introduce more fuel into the cylinder 21 during, for example, a cold start condition.

The method 56 is initiated at step 58. At step 60, the pressure sensor 52 senses the pressure of the fuel in the fuel rail 42 and sends a signal indicative of the fuel pressure to the microcontroller 54. At step 62, the microcontroller 54 determines the current operating condition of the vehicle. For example, the microcontroller 54 determines whether a normal operating condition exists or whether a condition exists that requires increased injector 44 operating time, such as during a cold start condition. At step 64, the microcontroller 54 determines whether to increase the operating time of the fuel injector 44 based upon the current operating condition determined in step 62. In the particular example shown, if the microcontroller 54 determines at step 62 that the motor vehicle is operating in a cold start condition, then the operating time of the fuel injector 44 will be increased and the method 56 advances to step 66. Otherwise the method returns to step 58 and steps 60, 62, and 64 are repeated.

At step 66, the fuel injectors 44 are activated during an expansion stroke of the piston 22. As shown in FIG. 3, the expansion stroke of the piston 22 begins when the piston 22 is positioned at the TDC position or 720° of crankshaft rotation. During the expansion stroke the piston 22 travels downward to the BDC position or 540° of crankshaft rotation. In one embodiment of the present invention, the fuel injector 44 is activated during a first half of the expansion stroke of the piston 22, or between about 720° to 630° of crankshaft rotation. In another embodiment of the present invention, the fuel injector 44 is activated during a second half of the expansion stroke of the piston 22, or between about 630° to 540° of crankshaft rotation. In still another embodiment of the present invention, the fuel injector 44 is preferably activated at between 620 to 660° of crankshaft rotation. The fuel injector 44 continues to operate throughout the remainder of the expansion stroke and inject fuel into the combustion chamber 26.

At step 68, the piston 22 is at the start of an exhaust stroke and positioned at BDC, or 540° of crankshaft rotation as illustrated in FIG. 3. During the exhaust stroke the piston 22 travels upward from the BDC position to the TDC position, or 360° of crankshaft rotation. The fuel injector 44 continues to operate throughout the exhaust stroke and more specifically from 540° to 360° of crankshaft rotation.

At step 70, the piston 22 is at the start of the intake stroke and positioned at the TDC position, or 360° of crankshaft rotation as illustrated in FIG. 3. During the intake stroke the piston 22 travels downward from the TDC position to the BDC position, or 180° of crankshaft rotation. The fuel injector 44 continues to operate throughout the intake stroke and more specifically from 360° to 180° of crankshaft rotation.

At step 72, the piston 22 is at the start of the compression stroke and positioned at the BDC position, or 180° of crankshaft rotation as illustrated in FIG. 3. During the compression stroke the piston 22 travels upward from the BDC position to the TDC or 0° of crankshaft rotation. The fuel injector 44 continues to operate from the start of the compression stroke, or at 180° of crankshaft rotation, until the end of injection ("EOI") 118 where the fuel injector 44 is deactivated and fuel injection terminates. Generally, fuel injection terminates prior to the pressure in the combustion chamber 26 reaching the pressure generated in the fuel rail 42 by the low pressure pump 34. In one embodiment of the present invention, the fuel injector 44 is deactivated during a first half of the compression stroke of the piston 22, or between about 180° to 90° of crankshaft rotation. In another embodiment of the present invention, the fuel injector 44 is deactivated during a second half of the compression stroke of the piston 22, or between about 180° to 0° of crankshaft rotation. In still another embodiment of the present invention, the fuel injector 44 is deactivated at between 80° to 40° of crankshaft rotation.

In conclusion, the present invention has many advantages and benefits over the prior art. For example, the method provides the ability to start direct injection internal combustion engines with various fuels i.e. Ethanol, Methanol, and gasoline without resealing (enlarging) current hardware to handle cold starts.

The description of the invention is merely exemplary in nature and variations that do not depart from the gist of the invention are intended to be within the scope of the invention. Such variations are not to be regarded as a departure from the spirit and scope of the invention.

What is claimed is:

1. A method for controlling the operation of at least one fuel injector in an internal combustion engine having a rotating crankshaft, the method comprising:

initiating fuel injection into a combustion chamber during an expansion stroke of a cold start of the engine;

injecting fuel into the combustion chamber during an exhaust stroke of the engine;

injecting fuel into the combustion chamber during an intake stroke of the engine; and terminating fuel injection into the combustion chamber during a compression stroke of the engine.

2. The method of claim 1 wherein initiating fuel injection into the combustion chamber further comprises initiating fuel injection during a first half of the expansion stroke of the direct injection internal combustion engine.

3. The method of claim 1 wherein initiating fuel injection into the combustion chamber further comprises initiating fuel injection during a second half of the expansion stroke of the direct injection internal combustion engine.

4. The method of claim 1 wherein initiating fuel injection into the combustion chamber further comprises initiating fuel injection between 620° to 660° of crankshaft rotation, wherein 0° of crankshaft rotation is the end of the compression stroke.

5. The method of claim 1 wherein terminating fuel injection into the combustion chamber further comprises terminating fuel injection during a first half of the compression stroke of the direct injection internal combustion engine.

6. The method of claim 1 wherein terminating fuel injection into the combustion chamber further comprises terminating fuel injection during a second half of the compression stroke of the direct injection internal combustion engine.

7. The method of claim 1 wherein terminating fuel injection into the combustion chamber further comprises terminating fuel injection between 40° to 80° of crankshaft rotation, wherein 0° of crankshaft rotation is the end of the compression stroke.

8. A system for controlling the operation of at least one fuel injector in a four stroke internal combustion engine having a rotating crankshaft, the system comprising:

a pressure sensor configured to sense the pressure in a fuel rail and transmit a signal indicative of the pressure;

a position sensor configured to sense the rotation of the crankshaft and transmit a signal indicative of crankshaft rotational position; and a microcontroller in communication with the pressure sensor for receiving the pressure signal and the position sensor for receiving the crankshaft rotational position signal, the microcontroller includes control logic for controlling the operation of the at least one fuel injector in response to the received pressure signal and the received crankshaft rotational position signal, the control logic comprising:

a first control logic for initiating fuel injection into a combustion chamber during an expansion stroke of a cold start of the engine;

a second control logic for injecting fuel into the combustion chamber during an exhaust stroke of the engine;

a third control logic for injecting fuel into the combustion chamber during an intake stroke of the engine; and a fourth control logic for terminating fuel injection into the combustion chamber during a compression stroke of the engine.

9. The system of claim 8 wherein the first control logic further comprises initiating fuel injection during a first half of the expansion stroke of the direct injection internal combustion engine.

10. The system of claim 8 wherein the first control logic further comprises initiating fuel injection during a second half of the expansion stroke of the direct injection internal combustion engine.

11. The system of claim 8 wherein the first control logic further comprises initiating fuel injection between 620° to 660° of crankshaft rotation of the engine, wherein 0° of crankshaft rotation is the end of the compression stroke.

12. The system of claim 8 wherein the fourth control logic further comprises terminating fuel injection during a first half of the compression stroke of the direct injection internal combustion engine.

13. The system of claim 8 wherein the fourth control logic further comprises terminating fuel injection during a second half of the compression stroke of the direct injection internal combustion engine.

14. The system of claim 8 wherein the fourth control logic further comprises terminating fuel injection between 40° to 80° of crankshaft rotation of the engine, wherein 0° of crankshaft rotation is the end of the compression stroke.

15. A method of operating an engine, the method comprising:

cold starting the engine;

initiating a fuel injection event into a combustion chamber during an expansion stroke of the engine during the cold start;

continuing the fuel injection event into the combustion chamber during an entire exhaust stroke of the engine;

continuing the fuel injection event into the combustion chamber during an entire intake stroke of the engine; and terminating the fuel injection event into the combustion chamber during a compression stroke of the engine.

* * * * *